US011846176B2

(12) United States Patent
Phelps et al.

(10) Patent No.: US 11,846,176 B2
(45) Date of Patent: Dec. 19, 2023

(54) RELEASE TOOL FOR DOWNHOLE OPERATIONS

(71) Applicant: GEODYNAMICS, INC., Millsap, TX (US)

(72) Inventors: Phil Phelps, Fort Worth, TX (US); John T. Hardesty, Fort Worth, TX (US); Dennis E. Roessler, Fort Worth, TX (US); Terrell Saltarelli, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 167 days.

(21) Appl. No.: 16/918,309

(22) Filed: Jul. 1, 2020

(65) Prior Publication Data

US 2021/0003000 A1 Jan. 7, 2021

Related U.S. Application Data

(60) Provisional application No. 62/902,534, filed on Sep. 19, 2019, provisional application No. 62/870,421, filed on Jul. 3, 2019.

(51) Int. Cl.

| | |
|---|---|
| ***E21B 47/07*** | (2012.01) |
| ***E21B 34/14*** | (2006.01) |
| ***E21B 34/06*** | (2006.01) |
| ***E21B 47/12*** | (2012.01) |

(52) U.S. Cl.

CPC ..... *E21B 47/07* (2020.05); *E21B 34/063* (2013.01); *E21B 34/14* (2013.01); *E21B 47/12* (2013.01)

(58) Field of Classification Search

CPC ..... E21B 47/07; E21B 47/12; E21B 34/14; E21B 34/063

See application file for complete search history.

(56) References Cited

U.S. PATENT DOCUMENTS

| | | | | |
|---|---|---|---|---|
| 3,677,081 | A * | 7/1972 | Newton | E21B 49/10 166/100 |
| 4,909,321 | A * | 3/1990 | Petree | E21B 23/14 166/385 |
| 8,499,826 | B2 | 8/2013 | Hillis et al. | |
| 10,677,032 | B1 * | 6/2020 | Norton | E21B 47/008 |
| 2004/0134667 | A1 * | 7/2004 | Brewer | E21B 17/023 166/242.6 |
| 2008/0308318 | A1 * | 12/2008 | Moore | E21B 4/04 175/51 |
| 2009/0301723 | A1 * | 12/2009 | Gray | G01V 11/002 166/301 |
| 2013/0160995 | A1 * | 6/2013 | Ocalan | E21B 19/08 166/381 |

(Continued)

FOREIGN PATENT DOCUMENTS

WO 2019182653 A1 9/2019

*Primary Examiner* — Christopher J Sebesta
(74) *Attorney, Agent, or Firm* — Morgan, Lewis & Bockius LLP

(57) ABSTRACT

A downhole tool for connecting and releasing portions of a tool string includes a housing; an electronics assembly; an activation mechanism; a valve assembly and a set of retainer dogs to connect and release a neck of another tool. The downhole tool may also include one or more measurement sensors for measuring a parameter and transferring one or more measured parameter values to the surface of the well.

19 Claims, 10 Drawing Sheets

(56) References Cited

U.S. PATENT DOCUMENTS

| | | | | |
|---|---|---|---|---|
| 2015/0292288 | A1* | 10/2015 | Kasperski | E21B 27/02 166/65.1 |
| 2018/0106127 | A1* | 4/2018 | Du | E21B 33/1285 |
| 2018/0347314 | A1 | 12/2018 | Hardesty et al. | |
| 2019/0284915 | A1 | 9/2019 | Perry et al. | |

* cited by examiner

RELEASE TOOL FOR DOWNHOLE OPERATIONS

CROSS REFERENCE TO RELATED APPLICATIONS

This application claims benefit and priority from U.S. Provisional Patent Application No. 62/870,421 filed on Jul. 3, 2019 and U.S. Provisional Patent Application No. 62/902,534 filed on Sep. 19, 2019, the content of both of which is incorporated in their entirety herein by reference.

BACKGROUND

Technical Field

Embodiments of the subject matter disclosed herein generally relate to downhole operations associated with an oil and gas well, and more specifically, to devices and methods for connecting and releasing a downhole tool or portions of a tool string within the wellbore.

Discussion of the Background

Wells for the extraction of hydrocarbons, typically oil and gas, require the use of various tools to perform the downhole operations within the wellbore which may include drilling, completion and production related activities. Tools, typically as a string of tools, need to be lowered into the well in a controlled manner by a conveyance method which may include wireline, slickline, and tubing based methods. Such tool strings may include drills, measurement and sampling devices, perforating guns, packers, plugs, valves, setting tools, various types of tubing and other tools run-in individually or in serial connection with one or more other tools.

Modern wellbores may be drilled vertically as well as horizontally and often have sections that undulate or deviate from planned trajectory. Since these deviations may occur within a relatively short distance; tight bends can occur within the casing. As a result, a tool or portions of a string of tools may become lodged within the casing and need to be released from the wireline in order to be later retrieved or drilled out through a separate operation.

Traditionally, as illustrated in FIG. 1, a system 100 for lowering a tool into a wellbore via a conveyance method 110 (wireline in this example) through a head 111 into the well 112 includes a wireline truck 120, its ground control system 130, and a crane 150 (only its boom is shown in the figure). System 100 may also include a lubricator device 116 to provide a seal around the wireline 110 as it enters the well. The lubricator device may also be suspended from the crane 150 or attached to the head 111 of the well 112. The wireline 110 is attached with one end to a winding drum 122 of the wireline truck 120 and a top sheave wheel 142 prior to entering the well. Wireline 110 is connected to a motor 125 (e.g., a hoist electric motor) controlled by a power controller 126.

The other end of wireline 110 is lowered into the well 112 and is attached to a tool or a string of tools 118. Tool(s) 118 may, for example, be one or a string of perforating guns, a sub, a toe-valve or other type of valve, a plug, a setting tool, or any combination of these or other downhole tools. Between wireline 110 and tool or tool string 118, a release tool 114 and stinger assembly 116 may be located to affect the release of tool 118 in the event the tool or string becomes lodged within the wellbore 112.

Release tools currently in use to provide disengagement of a tool from the conveyance vary principally in their source of power to affect the release and include electronic and motor driven devices, as well as explosively activated and complex pressure driven approaches. Such devices suffer from a high degree of complexity, lack of reliability and do not provide confirmation that disengagement downhole has occurred. Thus, there is a need for a new release tool that provides for disengagement utilizing simplified mechanisms, without use of explosives, and has higher reliability and the ability to measure and convey information as to the state of the tool string, as well as wellbore conditions.

SUMMARY

According to an embodiment, there is a release tool for connecting and releasing one or more downhole tools of a tool string located within a wellbore. The release tool includes a housing having an axial bore and an upper section and a lower section connected by a main sub, an electronics assembly within the housing and configured to communicate with the surface of the wellbore, an activation mechanism within the main sub and configured to receive an electrical current from the electronics assembly, a valve assembly within the main sub and in operative communication with the activation mechanism and has a first piston to open a passageway to wellbore fluid, a second piston within the lower section of the housing held in an initial downward state by a spring, plural retainer dogs within the axial bore of lower section of the housing having an engagement recess disposed on an inner radial surface for clamping a portion of a tool string. The second piston includes a cavity that retains the plural retainer dogs in a clamped state until the second piston is acted upon by the wellbore fluid.

According to another embodiment, there is a release tool for connecting and releasing one or more downhole tools of a tool string located within a wellbore. The release tool includes a housing with an axial bore, a burst disk configured to open a passageway to wellbore fluid upon breakage at a predetermined pressure, a piston within the housing held in an initial downward state by a spring, and plural retainer dogs with an engagement recess for clamping a portion of a tool string. The piston includes a cavity to retain the plural retainer dogs in a clamped state until the piston is acted upon by wellbore fluid.

According to still another embodiment, there is a wireline release tool and measurement system. The system includes a wireline for lowering a tool string into a wellbore, a housing attached to the wireline with an axial bore and an upper section and a lower section connected by a main sub, an electronics assembly within the upper section of the housing to communicate with the surface of the wellbore via the wireline, a release assembly with plural retainer dogs within the axial bore of the lower section of the housing with an engagement recess on an inner radial surface for clamping and releasing a portion of a tool string. The release tool and measurement system also includes a measurement sensor within the main sub and to measure a parameter and communicate a measured value to the electronics assembly.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a wireline tool disposed inside of a well. However, the embodiments discussed herein are not limited to a wireline in a well, but they may be applied to other conveyances and tools that are introduced into an enclosure which may call for a disengagement.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a pressure actuated release tool is attached to a wireline and lowered downhole with a tool string. The release tool's electronics module receives a command from a surface communications panel to initiate disengagement and a fusible or degradable link causes a valve piston to shift which opens a passageway for the inflow of pressurized wellbore fluid into a chamber. The pressurized wellbore fluid acts upon a second spring-loaded piston which shifts position within a housing to cause a set of retainer dogs clamped to a downhole tool to open. The opening of the retainer dogs then allows for disengagement of a tool or a portion of tool string that is to be released.

For purposes of this disclosure, terms such as "upper", "upward" or "uphole" and conversely "lower", "downward" or "downhole" are used herein to refer to the position of a particular tool, or the position of a particular feature within a tool, in relation to its position within the wellbore. Thus terms "upper, "upward" or "uphole" refer to a position above another tool or feature in a vertical section of a well or a position generally closer to the surface of a well having vertical and horizontal sections. Similarly, "lower", "downward" or "downhole" is a position closer the end or the toe of the well. In the accompanying figures, "upper", "upward" or "uphole" will generally be depicted as to the left in a figure unless indicated otherwise.

Figure 1:
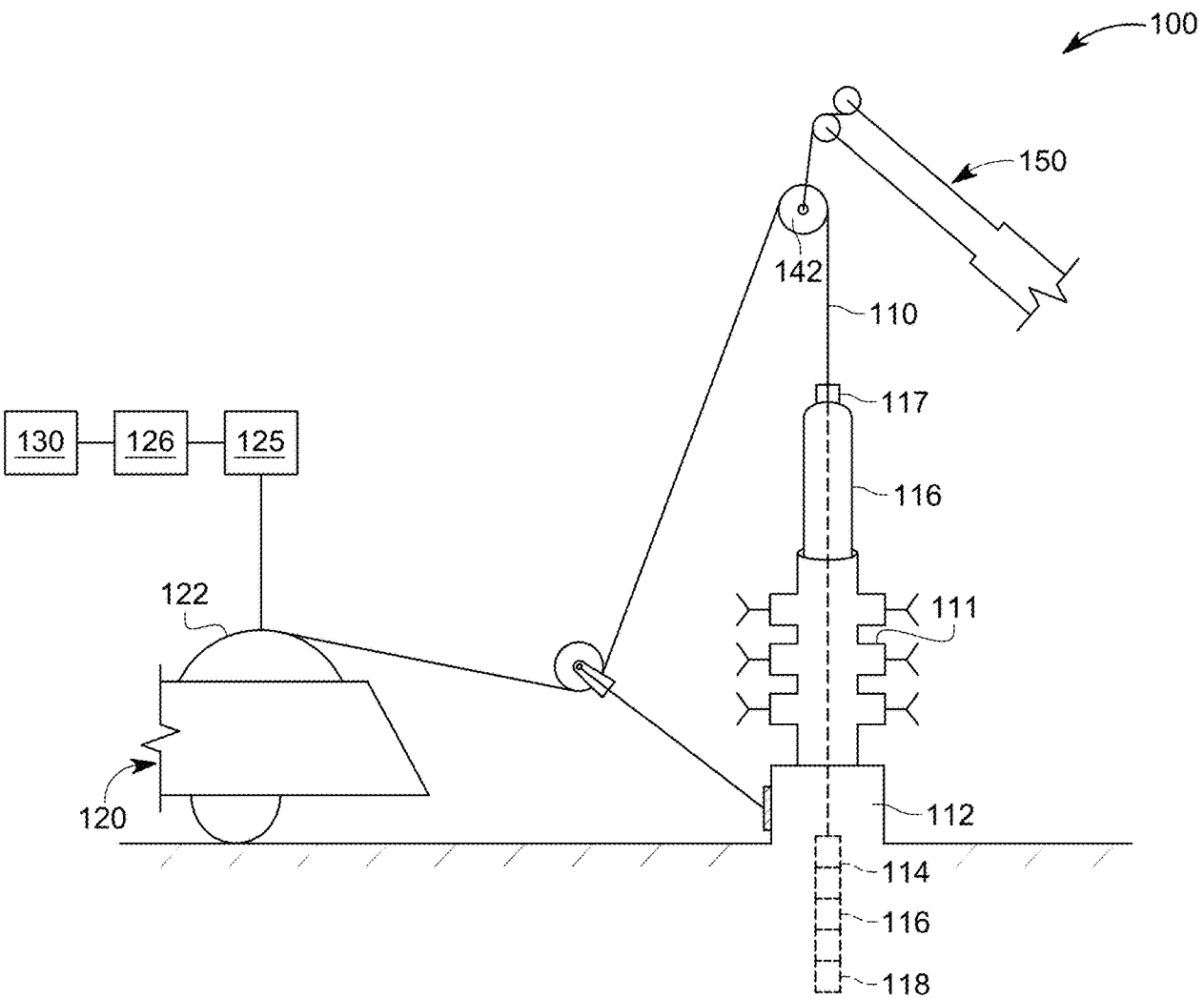
FIG. 1 (BACKGROUND ART)
FIG. 1 illustrates a traditional wireline system with a release tool.
Figure 2:
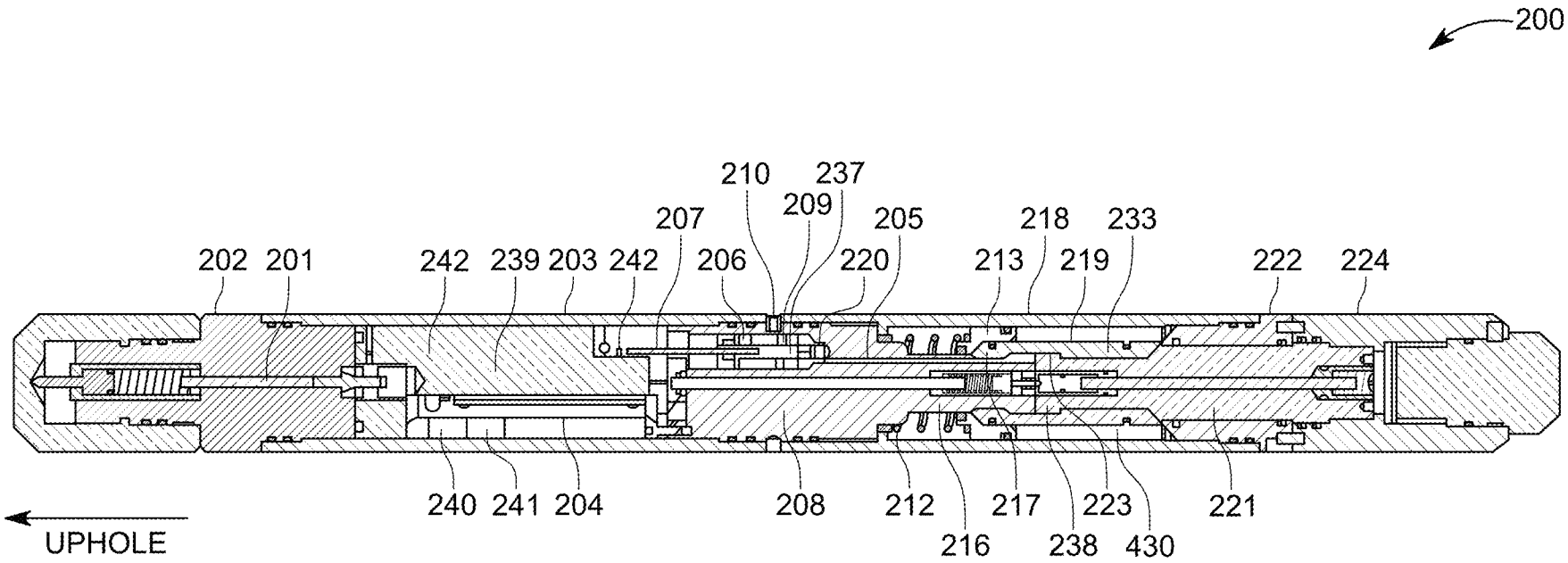
FIG. 2 illustrates an exemplary release tool.

According to an embodiment as shown in FIG. 2, a top (upper) sub assembly 202 with an internal electrical feedthrough 201 is provided for connection to a wireline (not shown) on the upper end of release tool 200. Those skilled in the art will appreciate that other components may be present in the upper portion of the tool string to include for example, CCLs, cable heads and the like. Sub assembly 202 is mechanically connected to an upper section of housing 203. Upper housing section 203 comprises an axial bore 239 which houses an electronics assembly module 204 in electrical communication with feedthrough 201 thus providing communication via the wireline to the well surface.

Upper housing section 203 is mechanically connected to main sub 208. Main sub 208 houses activation mechanism 206 and valve assembly 209 including a first piston 237 (these aspects will be discussed and shown in greater detail below). Main sub 208 also includes an internal channel that provides for a fluid passageway 205 upon activation and opening of the valve assembly 209. Main sub 208 mechanically connects to lower housing section 218. Between upper 203 and lower 218 housing sections, port 210 provides fluid communication between the release tool 200 exterior and valve assembly 209.

The lower end of main sub 208 may further include an integrally machined section or a separately attached body that forms an extension 216 on the downward end of main sub 208 that is of smaller diameter than the I.D. of lower housing 218. Extension 216 acts as a fixed base for spring 212 and as a body upon which a locking collar piston 213 may slidably translate up and down. For simplicity, locking collar piston 213 hereafter will be referred to as "second piston". Second piston 213 may be shaped on the downward end to include a cavity 217 sized to accept at least an upper portion of one or more retainer dogs 219. While the term "retainer dog" or "retainer dogs" may be used herein; these sections may be alternatively referred to as segments, locking segments, clamping segments, collet fingers, sections or segments, or multiple dogs may be referred to collectively as a singular collet.

In certain embodiments, three to eight retainer dogs 219 may be employed with each located fully within the axial bore 239 of the lower section 218 of the housing. In a preferred embodiment, each retainer dog 219 is typically comprised of a finger-like body 233 the base (upper) end of which is held in cavity 217 of second piston 213 thus holding the retainer dog in a fixed position corresponding to a closed or clamped state without the use of shear screws, lock rings or other frangible connection. The distal (lower) end of retainer dog 219 may include an engagement recess 223 disposed on an inner radial surface of finger 233 suitable to radially engage and lock onto the uphole neck 238 of a stinger assembly 221. Note that a stinger assembly may also be referred to as a "fishing neck" and serves as a releasable point and provides for mechanical connection to one or more tools lower in the string. Downhole from stinger assembly 221 may include an adaptor 224 or locking sub 222 and other tools necessary to make connection to a subsequent tool or tools lower in the string.

Turning to FIGS. 3, 4A, 4B, and 4C with continued reference to FIG. 2, the electronics assembly 204, activation mechanism 206 and valve assembly 209 of release tool 200 will now be discussed in greater detail. In an embodiment, after receiving the release command from a surface communications panel, the electronics assembly 204 as shown in FIG. 2 applies current via conduit 301 to a fusible link 304 which heats resistive element 314 of activation mechanism 206 as shown in FIG. 2 and in greater detail in FIG. 3.

Figure 3:
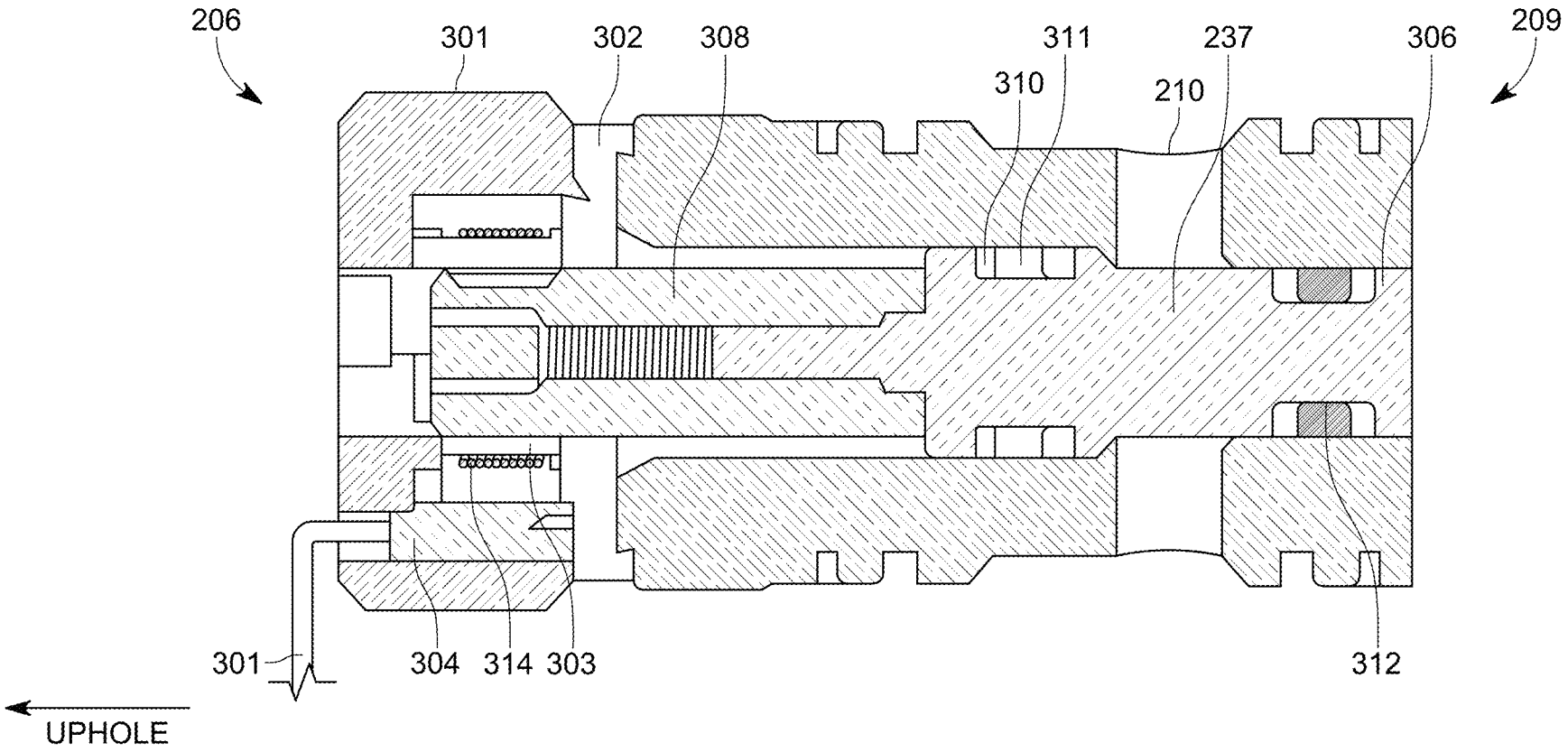
FIG. 3 illustrates an exemplary activation mechanism of a release tool.

Activation mechanism 206 thus may act as a split spool device as described in U.S. Patent Application 2018/0347314 also assigned to the present applicant and incorporated herein by reference for all purposes. Activation mechanism 206 is operatively connected to valve assembly 209, and in a preferred embodiment as shown in FIG. 3, activation mechanism 206 is housed in the same multi-part body as valve assembly 209.

Activation mechanism 206 may comprise a fuse or fusible link 304, and a resistive element 314 surrounding separable elements 303 enclosed within retainer head 301. For example, the fusible link 304 may be adjacent to or around or looped through the resistive element which maintains the resistive element in a wound state. Resistive element 314 may be provided as a torsional spring which in a compressed state holds center pin 308 in a restrained position. Once resistive element 314 breaks as a result of the heat applied; it frees separable elements 303 holding center pin 308 thus allowing it to move upward (uphole).

Valve assembly 209 comprises an internal piston 237 (hereinafter "first piston") mechanically coupled with center pin 308 with first piston 237 housed within valve assembly body 306. Center pin 308 thus provides a mechanical linkage between the activation mechanism 206 principally housed within the retainer head 301 and first piston 237 of valve assembly 209. Retainer head 301 and valve assembly body 306 may be joined at a mating plate 302. First piston 237 is sealed via one or more O-rings 311 or other type seal within orifice 310 of valve assembly body 306 and thus may slidably translate therein. In preferred embodiments, once center pin 308 is freed by disengagement of separable elements 303, the center pin 308 and first piston 237 become movable under the force of wellbore pressure acting through port 210. In other embodiments, a secondary spring in a compressed state could be located at the base of first piston 237.

Recall from above, that main sub 208 mechanically connects upper 203 and lower 218 housing sections, and that port 210 located between the two sections provides fluid communication between the release tool 200 exterior and valve assembly 209. As illustrated in FIG. 3, when first piston 237 shifts position in an uphole direction, a concentrically narrowed region 312 on first piston 237 aligns with port 210 thus allowing pressurized wellbore fluid to enter into passageway 205 located in main sub 208 (see FIG. 2).

Figure 4A:
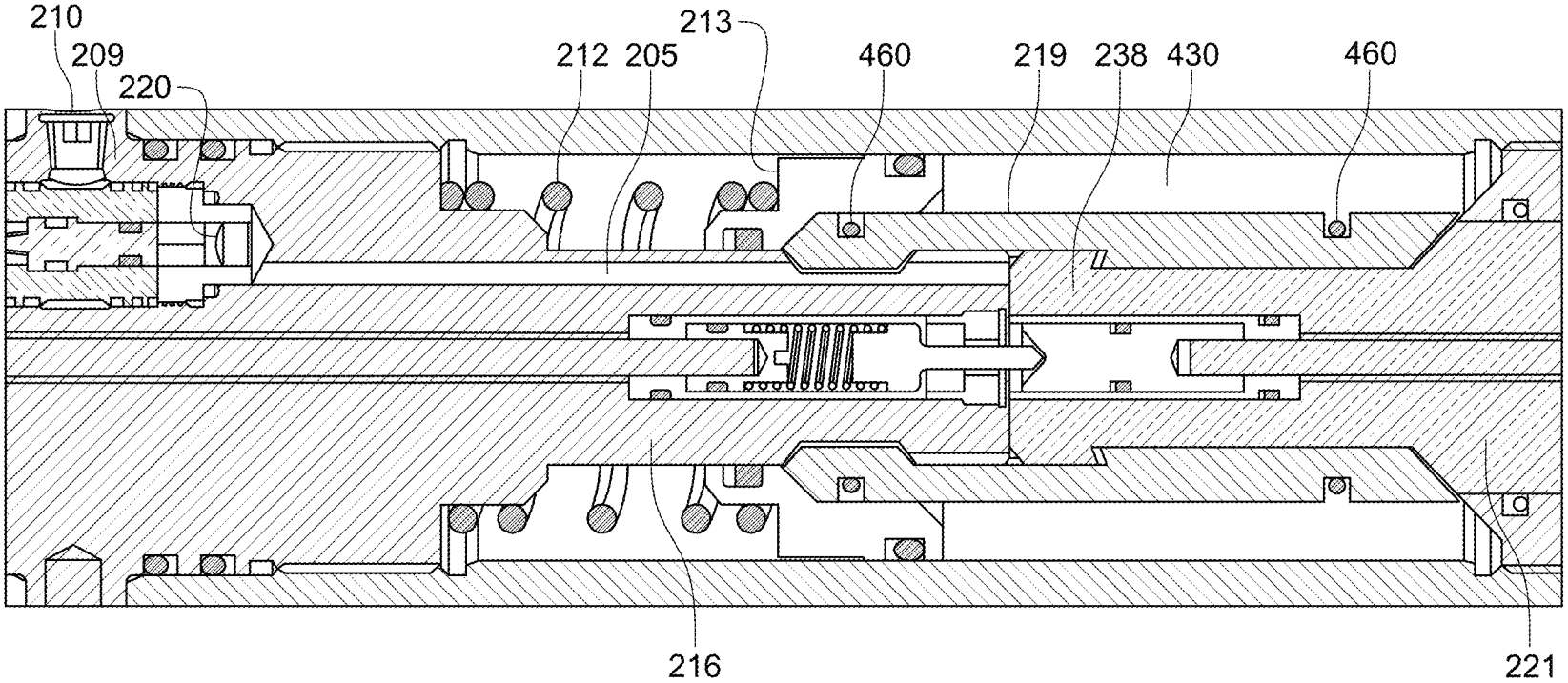
FIG. 4A illustrates an exemplary valve assembly of a release tool in a closed state.
Figure 4B:
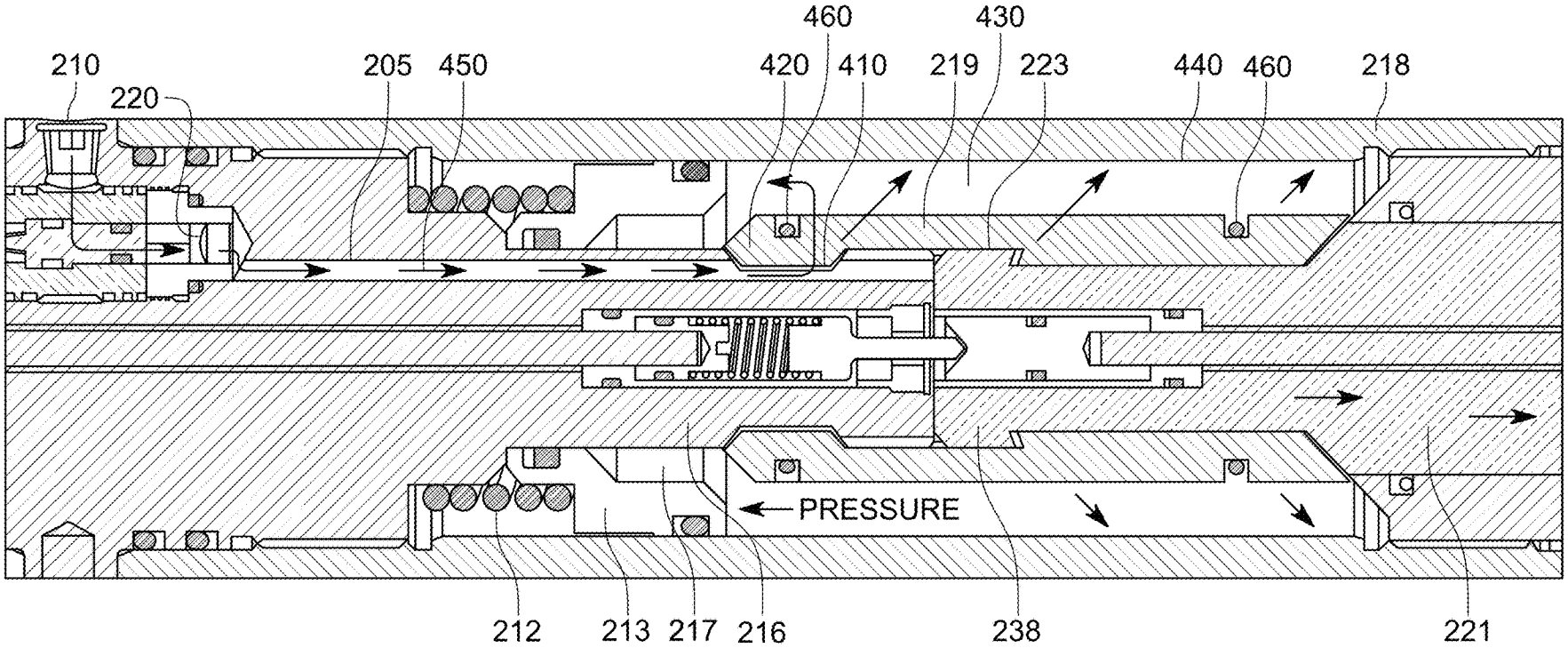
FIG. 4B illustrates an exemplary valve assembly of a release tool in a near open state.
Figure 4C:
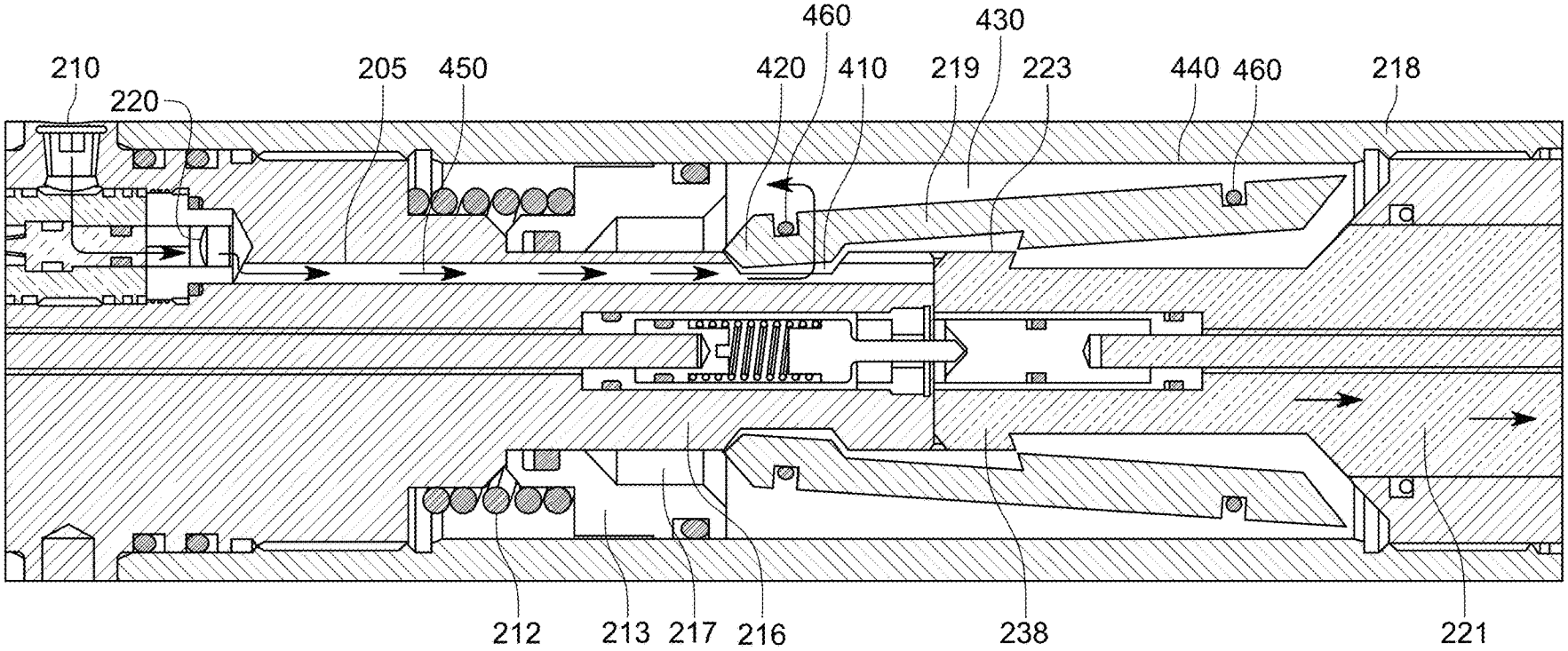
FIG. 4C illustrates an exemplary valve assembly of a release tool in an open and released state.

FIGS. 4A, 4B and 4C show in greater detail the valve assembly 209 and other components of the release tool 200 of FIG. 2. FIG. 4A shows retainer dogs 219 in the locked or clamped state, while FIG. 4B shows them in a near unlocked state, i.e. freed from cavity 217 of second piston 213 but not yet opened to disengage the fishing neck 238. FIG. 4C shows the engagement recess 223 of retainer dogs 219 freed and thus disengaged from fishing neck 238.

In certain embodiments as shown in FIGS. 4A-C, a burst disk 220 may be located adjacent or within passageway 205. A burst disk is chosen with a threshold pressure to prevent activation of the valve below a certain pressure. Burst disk 220 thus adds an additional safety factor against inadvertent activation. In other embodiments described below, release tool 200 may be activated directly from the breakage of the bust disk.

Valve assembly 209 may also include a switch mechanism capable of providing feedback to the surface as to the state of the valve. This provides valuable confirmation to the surface as to the current state of release tool 200. In certain embodiments, referring back to FIG. 2, a spring-loaded stem 207 may also shift uphole when separable elements 303 of FIG. 3 are released. Alternatively, stem 207 may be connected to or be an extension of center pin 308 and thus shifting with it in an uphole direction once activated. In still other embodiments, a stem 207 may act under differential pressure once pressurized wellbore fluid enters the release tool. Stem 207 thus acts as a switch contact that triggers a point contact 242 to send a signal to electronics assembly 204 which in turn signals the surface that the valve 206 has been activated. Alternatively, in embodiments that do not include an electronics assembly, valve assembly 209 may be directly wired to send the signal directly to the surface.

Returning to FIGS. 4B and 4C, 4B illustrates release tool 200 in the process of achieving a released state. As described above, once valve assembly 209 opens, wellbore fluid flows through passageway 205. FIG. 4B indicates the flow path of the wellbore fluid via arrows 450 as it exits passageway 205 through one or more orifices or annular spaces 410 around or through the head 420 of retainer dogs 219 and into atmospheric chamber 430 formed by a sealed space located between the retainer dogs and the inner wall 440 of the lower 218 section of housing.

Pressurization of atmospheric chamber 430 pushes second piston 213 uphole thus compressing spring 212. Therefore in this embodiment, since passageway 205 extends through main sub 208 to below second piston 213; piston 213 moves towards the port 210 rather than away from the port. In this regard, piston 213's movement is opposite the direction of the inflow of fluid. This approach advantageously provides for piston 213 to act as both a retention and a release device for the retainer dogs 219 whereby piston 213 is shifted and retainer dogs 219 are released as a result of pressurization of a single atmospheric chamber 430 located below the second piston 213. Further, the presently disclosed release assembly comprising the second piston 213 with cavity 217 that both retains and releases retainer dogs 219 from an uphole neck 238 of downward tool does not require the use of shear screws, breakable lock ring or other frangible connection.

With second piston 213 shifted uphole, retainer dogs 219 are freed from cavity 217 and engagement recess 223 disengages from the uphole neck 238 of the stinger assembly 221, i.e. the "fishing neck" is released and release tool 200 is now separated from the stuck downward tool or tools and can be withdrawn from the wellbore. FIG. 4*c* illustrates the disengagement of retainer dogs 219 from stinger assembly 221. Note that one or both ends of retainer dogs 219 may include an elastomeric ring 460 or other type of clasp mechanism for purposes of retaining the dogs within the housing once they have disengaged from the fishing neck 238.

In other embodiments, electronics assembly 204 may also include an electronic circuit 240 comprising a timer 241 (FIG. 2) configured to provide a time delay between the passage of a signal from the surface to initiate release and the time that a current is applied via conduit 301 to fusible link 304 which heats resistive element 314. In other embodiments that circuitry may include a unique identifier thus making release tool 200 an addressable tool within a string of tools where each tool in the string may also be uniquely identified. In other embodiments, release tool 200 may operate without electronics or with the electronics disabled. For example, a current may be sent directly from the surface or another power source directly to fusible link 304.

An exemplary method for operation of an exemplary release tool comprises the following stages: a signal from the surface controller is provided downhole via a wireline 110 to electronics assembly 204; electronics assembly 204 sends an electrical current to fuse link 304 of activation mechanism 206; fusible link 304 heats restriction element 314 which breaks and frees separable elements 303; separable elements 303 disengage center pin 308 which moves uphole; first piston 237 of valve assembly 209 shifts uphole opening a pathway through opening 210; pressurized wellbore fluid flows into passageway 205 of main sub 208, second piston 213 compresses spring 212 and frees retainer dogs 219 from cavity 217; and consequently retainer dogs 219 disengage from fishing neck 238 of stinger assembly 221.

Figure 5:
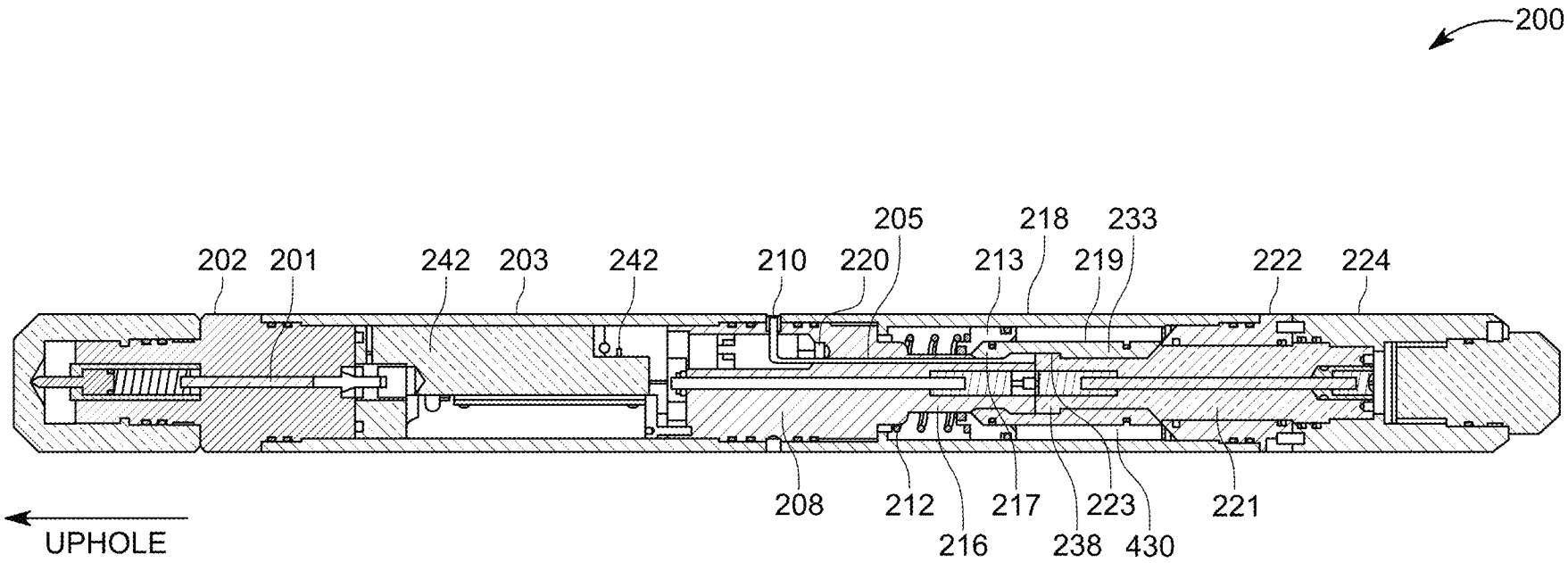
FIG. 5 illustrates another exemplary embodiment of a release tool.

In yet other embodiments, as shown for example in FIG. 5, actuation mechanism 206 and valve assembly 209 may be replaced entirely or in part by direct operation with burst disk 220 such that initiation of the device is produced from pressurization of the wellbore above a prescribed threshold pressure to cause disengagement of retainer dogs 219. In this approach, burst disk 220 may be located in main sub 208 but is in direct fluid communication with port 210 and thus is acted upon by wellbore pressure. Once a prescribed threshold wellbore pressure is exceeded by a surface pump acting on the wellbore fluid; burst disk 220 breaks and allows fluid to enter passageway 205.

Embodiments of the release tool 200 may also include a current feed-through current path designed around a pass-through switch as described in pending co-assigned U.S. patent application Ser. No. 16/194,580, which is incorporated herein by reference for all purposes. The current feed-through comprises a pass-through switch located inside the electrical assembly housing 204 and electrically connected between an electrical input and an electrical output; and a circuit limiter device located inside the same housing and electrically connected between the electrical input and the electrical output. The pass-through switch is connected in parallel to the circuit limiter device, between the electrical input and the electrical output for testing a downhole tool without closing a pass-through switch in the release tool.

Figure 6A:
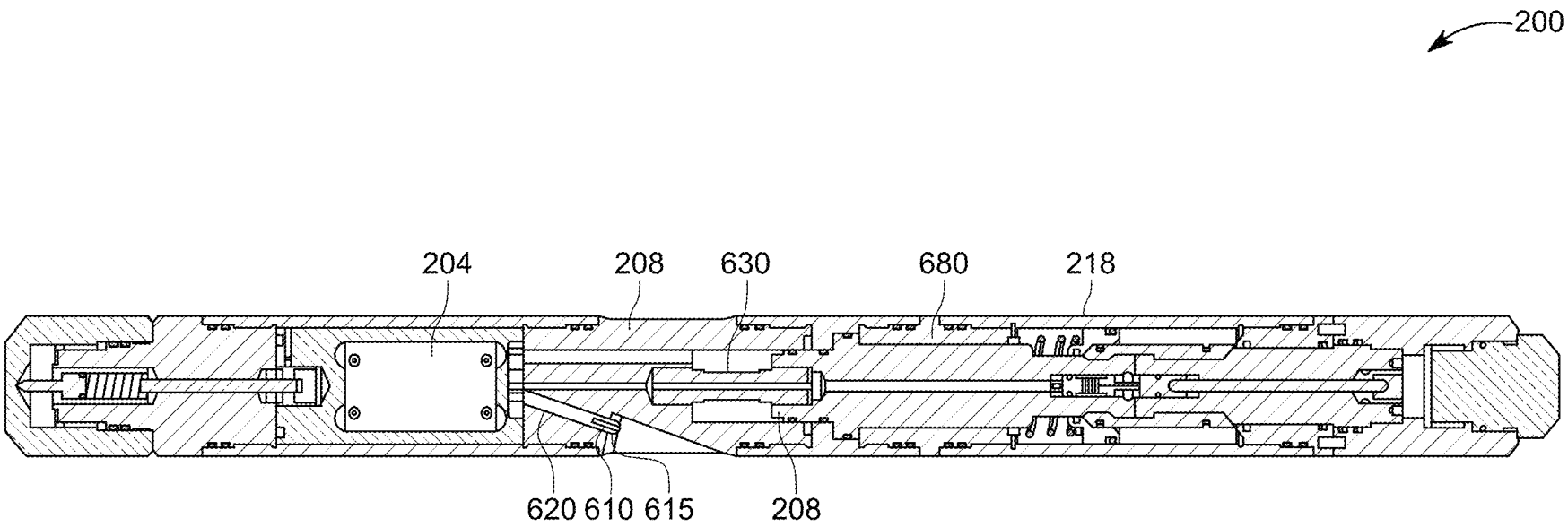
FIGS. 6A and 6B illustrate an exemplary release tool and measurement system.
Figure 6B:
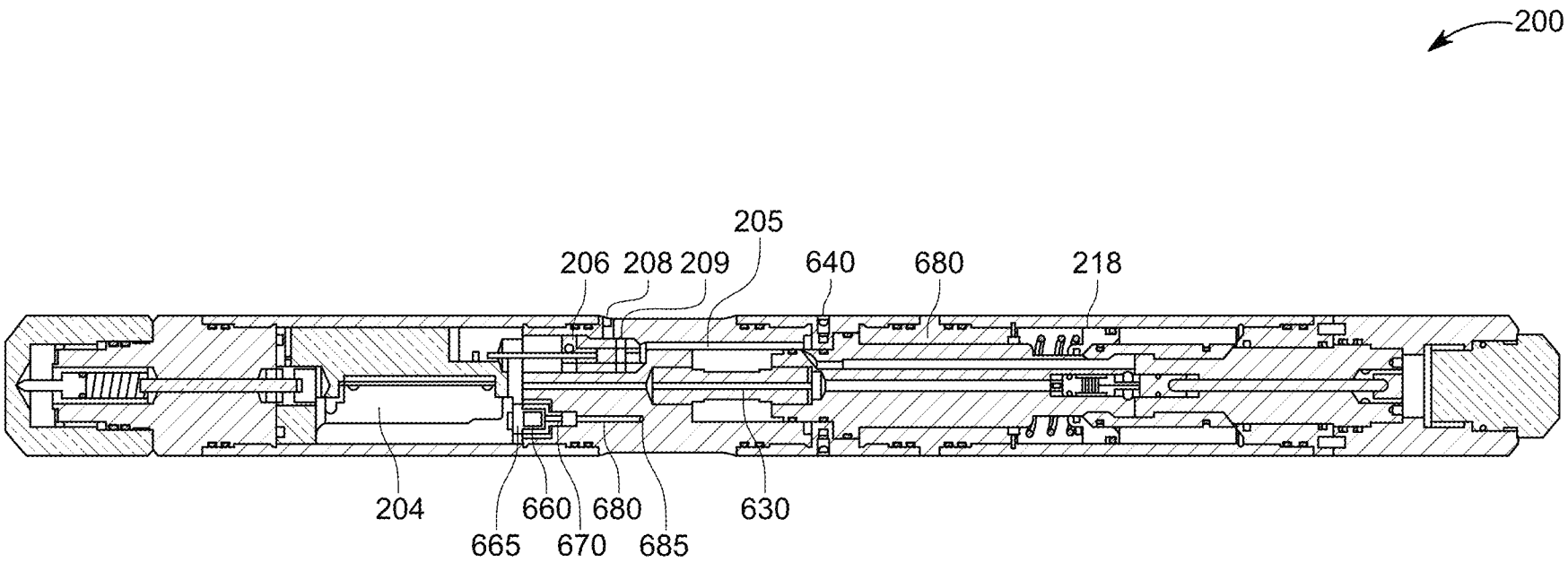

In yet other embodiments, main sub 208 of release tool 200 may house additional components in the form of a variety of sensors. Such a system thus provides for downhole tool release as well as the capability to measure various wellbore parameters and parameters related to the tool string. FIGS. 6A and 6B illustrate an example of a release tool 200 with multiple sensors which include a pressure transducer 660, a temperature probe 610, and a tension transducer 630. Other individual sensors and combinations of these and other sensors are readily contemplated herein. For example, an accelerometer may also be added to the circuit board of the electronics assembly 204 of one or more of these embodiments to provide for measurement of acceleration. Furthermore, such sensors may be housed in the same main sub 208 or separate subs. In other embodiments, the release tool and measurement system may be modularized with individual sensors located in distinct subs and thus the combination of desired sensors easily customizable.

FIGS. 6A and 6B depict a single release tool in two rotated views to show multiple sensors within main sub 208. In FIG. 6A, actuation mechanism 206 and valve assembly 209 of release tool 200 are rotated out of view on the back side so as to show temperature probe 610 located within recess 620 of main sub 208. Temperature probe 610 is thus sealed within main sub 208 and its sensor head 615 is in contact with and capable of measuring the wellbore temperature exterior the tool and transmitting the value to electronics assembly 204 which in turn may store the value(s) or transmit them uphole to the surface.

Also shown in FIG. 6A, a tension transducer 630 may be centrally located within main sub 208 and is also in communication with electronics assembly 204. As shown in FIG. 6B, for embodiments which include tension transducer 630, there is a need for an additional port 640 located either in the wall of main sub 208, directly in the wall of lower housing 218, or in a secondary sub or adaptor 680 to provide for a differential piston area which acts to pressure balance both ends of a tension transducer such that the tension measurement is not affected by downhole pressure acting on the tool.

Also shown in FIG. 6B is a pressure transducer 660 suitable for measuring wellbore pressure also located within main sub 208 and in communication with electronics assembly 204. The main body 665 of pressure transducer 660 is sealed within main sub 208 and its sensor end 670 is in fluid communication with channel 680 within the body of main sub 208. An orifice 685 is drilled into main sub 208 to intersect channel 680 to provide fluid communication between the sensor and the tool exterior.

Figure 7:
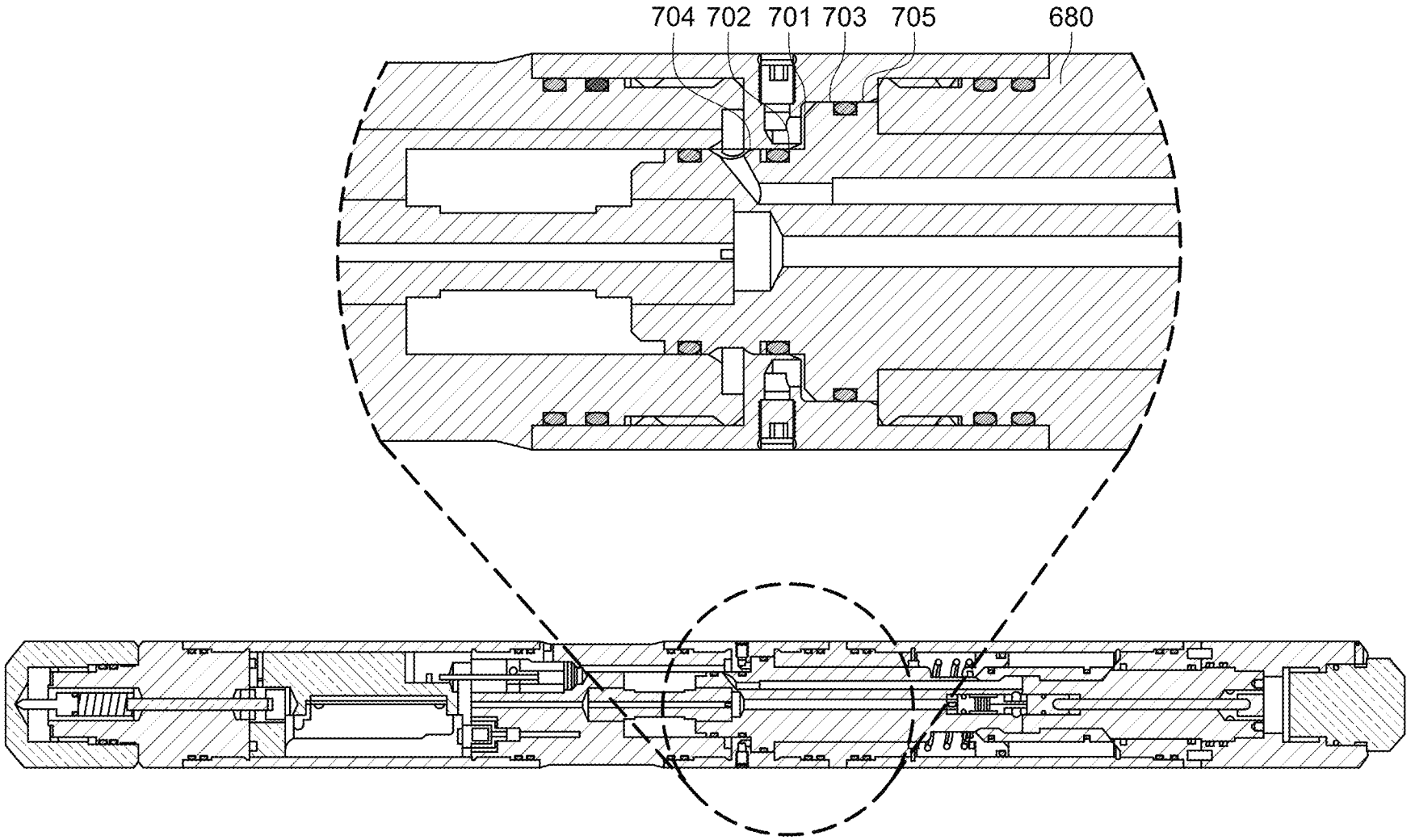
FIG. 7 illustrates an exemplary tension transducer pressure compensation assembly.

FIG. 7 illustrates an exemplary pressure-compensation chamber mechanism to increase the accuracy of the tension measurement. When connected in a gun string, the release tool 200 within a tool string is not normally pressure balanced. The cross sectional area of the fishing neck, and the difference in the cross sectional area of the fishing neck versus a (for example) 1⅝" ACME connection on the bottom of the tool (totaling to the cross sectional area of the 1⅝" ACME connection), acts to compress the tension transducer 230 into the tool when under pressure as they are acting against the atmospheric pressure inside lower housing 218.

To compensate for this pressure-driven compression, another pressure compensating chamber 701 may be disposed within a section of wall of secondary sub 680. Chamber 701 provides two different diameter sealing surfaces 702 and 703 that are exposed to wellbore pressure versus atmospheric pressure on the other sides of the surfaces 704 and 705 inside the secondary sub 680. The difference between the areas is equivalent to the area of the 1⅝" ACME connection in this example. The larger diameter of sealing surface 703 is on the downhole end, past tension transducer 630, thus providing a pulling force on the transducer. This results in the reduction of the net force on the tension transducer 630 due to well pressure acting on the piston areas and ideally fully compensates for the compressive effects such that the net force approaches zero. This enables an improved accuracy in the tool tension measurement.

The disclosed embodiments provide a downhole release tool for disengagement of a tool or portions of a tool string within a wellbore. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details. For example, where the phrase "mechanically connected" may be used therein, those skilled in the art of downhole tool design will readily contemplate that such connections may be provided by threads, including box by pin connections, lock rings, quick connects, collared connections, welding or other methods of joining mechanical components.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An apparatus for connecting and releasing a downhole tool located within a wellbore comprising:

a housing having an axial bore;

an electronics assembly configured to communicate with the surface of the wellbore;

an activation mechanism configured to receive an electrical current from the electronics assembly;

a valve assembly in operative communication with the activation mechanism and having a first piston configured to open a port in the housing to wellbore fluid;

a second piston slidably engaged with the housing and held in an initial downward state by a spring;

plural retainer dogs each having an engagement recess disposed on an inner radial surface thereon configured for clamping a neck of a tool when the retainer dogs are in a first position; and wherein said second piston further comprises a cavity configured to retain said retainer dogs in the first position and to allow the retainer dogs to move radially outward to a second position when the second piston is acted upon by the wellbore fluid.

2. The apparatus of claim 1 wherein the housing is comprised of an upper section and a lower section connected by a main sub.

3. The apparatus of claim 2, wherein the activation mechanism is located within the main sub.

4. The apparatus of claim 2, wherein the valve assembly is located within the main sub.

5. The apparatus of claim 1, wherein the valve assembly further comprises a burst disk.

6. The apparatus of claim 1, wherein valve assembly is further configured to activate a switch to communicate a state of the valve to the electronics assembly.

7. An apparatus for connecting and releasing a downhole tool located within a wellbore comprising: a housing having an axial bore;

a burst disk located within the housing and configured to open a passageway to wellbore fluid upon breakage at a predetermined pressure;

a piston located within the housing and held in an initial downward state by a spring;

plural retainer dogs having an engagement recess disposed on an inner radial surface thereon configured for clamping a neck of a tool when the retainer dogs are in a first position; and wherein said piston further comprises a cavity configured to retain said retainer dogs in the first position and to allow the retainer dogs to move radially outward to a second position when the piston is acted upon by wellbore fluid.

8. The apparatus of claim 7, wherein the housing is comprised of an upper section and a lower section connected by a main sub.

9. The apparatus of claim 8, wherein the burst disk is disposed within the main sub.

10. A wireline release tool and measurement system, the system comprising:

a wireline for lowering a tool string into a wellbore;

a housing attached to the wireline and comprising an upper section, a lower section, and an axial bore;

a main sub connecting the upper section and lower section of the housing;

an electronics assembly configured to communicate with the surface of the wellbore via the wireline;

a release assembly comprising plural retainer dogs each having an engagement recess disposed on an inner radial surface thereon configured to clamp a neck of a tool when the retainer dogs are in a first position and to release the neck when the dogs move radially outward to a second position, such that the housing and the tool are separated from each other and the housing may be pulled out of the wellbore using the wireline; and a measurement sensor disposed within the main sub and-configured to measure a parameter and communicate a measured value to the electronics assembly.

11. The system of claim 10, wherein the release assembly further comprises a valve assembly located in the main sub configured to open a passageway to wellbore fluid.

12. The system of claim 10, wherein the release assembly further comprises a piston having a cavity configured to retain said plural retainer dogs in a clamped state until said piston is acted upon by wellbore fluid.

13. The system of claim 10, wherein the measurement sensor is a temperature sensor for measuring wellbore temperature.

14. The system of claim 10, wherein the measurement sensor is a pressure transducer for measuring wellbore pressure.

15. The system of claim 10, wherein the measurement sensor is a tension transducer for measuring tension of the tool string.

16. The system of claim 15, wherein the tension measurement further comprises a pressure compensation chamber to compensate for the pressure driven compression of the tension transducer.

17. The system of claim 16, wherein the pressure compensation chamber is further comprised of more than one sealing surface with varying cross-sectional area to pressure balance the transducer relative to the wellbore exterior pressure.

18. The system of claim 16, wherein the pressure compensation chamber is disposed within a second sub separate from the main sub.

19. The system of claim 10, wherein the electronics assembly comprises:

a housing;

a processor that is electrically connected to both the release assembly and the at least one measurement sensor; and wherein the processor is configured to receive a signal from the surface of the wellbore to initiate the release assembly and transmit a measured parameter measured by the measurement sensor to the wellbore surface via the wireline.

* * * * *